United States Patent [19]

Bachman

[11] Patent Number: 4,967,957

[45] Date of Patent: Nov. 6, 1990

[54] INJECTION MIXER

[75] Inventor: Wesley J. Bachman, Auburn, Ill.

[73] Assignee: Dickey-john Corporation, Auburn, Ill.

[21] Appl. No.: 431,028

[22] Filed: Nov. 2, 1989

[51] Int. Cl.[5] ..... B05B 7/00

[52] U.S. Cl. ..... 239/62; 222/57; 222/155; 222/310; 239/71

[58] Field of Search ..... 239/61, 62, 71, 155, 239/156, 157, 304, 305, 307, 308, 310; 222/57

[56] References Cited

U.S. PATENT DOCUMENTS

| | | | |
|---|---|---|---|
| 2,757,044 | 7/1956 | Gerbracht | 299/43 |
| 3,782,634 | 1/1974 | Herman | 239/156 |
| 3,877,645 | 4/1975 | Oligschlaeger | 239/155 |
| 4,052,003 | 10/1977 | Steffen | 239/71 |
| 4,121,767 | 10/1978 | Jensen | 239/71 |
| 4,301,944 | 11/1981 | Lestradet | 239/156 |
| 4,322,034 | 3/1982 | Fox | 239/155 |
| 4,530,463 | 7/1985 | Hiniker et al. | 239/71 |
| 4,691,850 | 9/1987 | Kirschmann et al. | 222/642 |
| 4,714,196 | 12/1987 | McEachern et al. | 239/62 |

FOREIGN PATENT DOCUMENTS

| | | | |
|---|---|---|---|
| 2048091 | 12/1980 | United Kingdom | 239/61 |

*Primary Examiner*—Andres Kashnikow
*Assistant Examiner*—Michael J. Forman
*Attorney, Agent, or Firm*—Richard Bushnell

[57] ABSTRACT

An injection mixing apparatus is provided for use with a spraying system carried on a mobile vehicle of the type including a spray bar, a carrier reservoir for holding a supply of a liquid carrier medium, a main pump interposed between the carrier reservoir and the spray bar, a flow control valve interposed between the main pump and the spray bar, a ground speed sensor for developing a ground speed signal corresponding to the speed of the vehicle, a pressure sensor for sensing the pressure across the spray bar and developing a corresponding pressure signal and a supply of chemical agent to be mixed with the carrier at a desired concentration for delivery at the spray bar. The injection mixing apparatus comprises at least one injection control loop with an injection pump coupled intermediate the supply and the main pump for injecting the chemical agent into the carrier ahead of the main pump, and an injection controller for controlling the injection pump. The injection controller comprises a tachometer for sensing the rotational speed of the injection pump and developing a corresponding rotational speed signal and a pump control circuit for developing a speed control signal for controlling the pump rotational speed in response to a first input signal and a feedback signal comprising the rotational speed signal. A system controller develops the first input signal and includes a circuit for developing a flow rate signal corresponding to the flow rate of material to the spray bar, and for applying this flow rate signal to the pump control circuit as the first input signal.

9 Claims, 1 Drawing Sheet

INJECTION MIXER

BACKGROUND OF THE INVENTION

This invention is directed generally to chemical injection spraying and more particularly to a novel and improved injection mixing apparatus for use with a spraying system.

For agricultural and/or highway chemical spraying, relatively large mobile spraying apparatus are utilized. Typically, such mobile spraying apparatus include a supply tank for the fluid to be sprayed, a pump, a flow control valve and a distribution boom fitted with a number of spray nozzles. Generally speaking, the desired spray mixture is premixed in a supply tank; i.e., at the desired, and constant, chemical concentration for a given application. Thereafter, a flow control system based on the ground speed of the vehicle and other parameters such as the desired application rate of the material, etc., as well as system parameters such as nozzle size, etc., is utilized to adjust the flow control valve as necessary to provide a uniform chemical application density at the desired application rate.

Such systems are advantageous in uses wherein a constant concentration of material is to be applied to a given area. However, it is somewhat difficult in such systems to vary the concentration after the liquid has been premixed in the supply tank. For example, if liquid at one concentration is being applied and it is desired to increase the concentration, an additional amount of the active chemical agent may be added to the supply tank, and some suitable means used to agitate or further mix the contents of the tank to achieve a uniform concentration. However, the operator must know approximately the volume of fluid remaining in the supply tank and perform calculations to assure arriving at the desired final concentration when adding chemical. In this regard, most applications consist of a carrier liquid such as water, which is mixed at a desired concentration, usually of no more than a few percent, with the active chemical agent of interest.

On the other hand, should the operator wish to decrease the chemical concentration, additional water may be added to the tank. Again, this requires some means of determining the remaining liquid in the tank and calculating the amount of water to be added to arrive at the desired new concentration This is, at best, a somewhat tenuous calculation and procedure.

Moreover, having added water to the tank, the operator may have considerable supply of fluid at the new concentration left over after the spraying is complete. This results in an undesirable amount of waste.

Accordingly, it has been proposed in situations where varying concentrations of a given mixture are to be applied at various times, to provide some sort of injection mixing to inject the chemical of interest at some point in the system prior to the spray boom or distribution boom. Because of the complexity and volume of the supply tubing and the overall size of such systems, there is considerable delay or lag time before a changed or new concentration being supplied at the injectors actually reaches the nozzles. The correct concentration will occur initially at the injection point and reach the nozzles only after a delay time which may be on the order of several or more seconds. For typical speeds of such sprayer vehicles, such a delay may result in a delay of from ten to one hundred or more feet of travel of the vehicle and hence a corresponding misapplication over a corresponding area.

We have recognized that the problem may be solved by the use of a carrier control based on not only the ground speed of the vehicle, but also a controlled chemical injection based on the flow rate of the carrier. That is, we have proposed a novel controller which not only controls the flow rate of liquid to the spray bar based upon the ground speed of the vehicle and the desired application rate, but also controls the rate of chemical injection into the flow in accordance with the flow rate of the carrier. Moreover, since typical chemical percentages of the carrier are on the order of a few percent, and often less than one percent, we have found that actual carrier flow need not be measured Rather, we have found that good control can be maintained by measuring the flow rate downstream of the main flow control valve to the spray bar; that is, after the point at which mixing takes place.

As a further matter, we have determined that an actual flow meter need not be provided in the system, since the carrier flow can be closely estimated by calculating the system parameters, the ground speed of the vehicle and by measuring the pressure across the spray bar. Generally speaking, it is a simpler matter to measure the pressure across the spray bar than to insert a flow rate meter in the supply line to the spray bar. In essence, our system provides a constant concentration of chemical in the system without the necessity of tank mixing. However, unlike tank mixing, our system provides for changes in desired concentration to be accommodated essentially instantly by providing the option of varying the application rate at the main flow control valve, since the system chemical concentration stays essentially constant at this point in the system. The lag time from an abrupt change in desired concentration is readily eliminated by gradually varying both the flow rate of the mixed chemical and the injection rate at the mixing point in a cooperative fashion to achieve a uniform and yet desired application rate at all times, while accommodating desired changes in concentration. That is, a changed concentration may be applied by varying application rate (flow to the nozzles or vehicle speed) as well as by changing concentration. However, we have also recognized in this regard, that the range of pressures and hence flow rates achievable with a given spray nozzle are limited. In practice, we have found that a given spray nozzle can only achieve a range of about a 2:1 ratio in the flow rate therethrough. This corresponds to about a 4:1 pressure range. This is because at much lower rates the pressure will be insufficient to maintain a true spray at the spray nozzle and the fluid will tend to "dribble". At higher flow rates, the pressure will be excessive, such that so-called "cavitation" will take place and a very nonuniform spray pattern will result.

Our novel control system, which utilizes both flow control of the flow of mixed fluid to the spray bar as well as injection control based on flow rate upstream of the main flow control valve makes it possible to accommodate these limitations of spray nozzles. That is, by taking into account the spray nozzle type and optimum range of pressures, it is possible to adjust both the flow rate to the spray bar and the injection rate into the carrier to achieve desired application rate control well within the allowable range of pressure at which fluid may be supplied and consequent flow rate which may be achieved with a given set of nozzles.

Our novel system permits great efficiency of spraying, good control over the application rate and over the desired concentration of sprayed chemical, and very little waste in spraying. In contrast to a premixed tank where all the mixture left in the tank must often be discarded after spraying, very little waste occurs in our system. With our proposed system, if a system clean-out and purging is desired, only the system plumbing need be purged and there is no relatively large tank or reservoir of premixed fluid which must be discarded or purged. That is, since the supplies of unadulterated carrier and of chemical of interest are kept separate until the injection point, only the intermediate system plumbing and lines to the spray bar need be purged or cleaned in order to accommodate changes in identity of chemical to be applied, or the like.

OBJECTS AND SUMMARY OF THE INVENTION

Accordingly, it is an object of this invention to provide a novel and improved chemical injection system for a mobile spray apparatus.

Briefly, and in accordance with the foregoing object and foregoing discussion, a controlled injection mixing apparatus is provided for a spraying system carried on a mobile vehicle of the type including an injection mixing apparatus for use with a spraying system carried on a mobile vehicle of the type including a spray bar, a carrier reservoir for holding a supply of a liquid carrier medium, a main pump interposed between said carrier reservoir and said spray bar, a flow control valve interposed between said main pump and said spray bar, a ground speed sensor for developing a ground speed signal corresponding to the speed of said vehicle, a pressure sensor for sensing the pressure across the spray bar and developing a corresponding pressure signal and a supply of chemical agent to be mixed with said carrier at a desired concentration for delivery at said spray bar. The controlled injection mixing apparatus comprises at least one injection control loop comprising injection pump means coupled intermediate said supply and said main pump for injecting said chemical agent into said carrier ahead of said main pump, and an injection controller for controlling said injection pump means; said injection controller comprising tachometer means for sensing the rotational speed of said injection pump means and developing a corresponding rotational speed signal and a pump control circuit for developing a speed control signal for controlling said rotational speed in response to a first input signal and a feedback signal comprising said rotational speed signal; and a system controller for developing said first input signal including means for developing a flow rate signal corresponding to the flow rate of material to the spray bar, and for applying said flow rate signal to said pump control circuit as said first input signal.

BRIEF DESCRIPTION OF THE DRAWINGS

The features of the present invention which are believed to be novel are set forth with particularity in the appended claims. The organization and manner of the operation of the invention, together with the further objects and advantages thereof may best be understood by reference to the following description, taken in connection with the accompanying drawing in which;

DETAILED DESCRIPTION OF THE ILLUSTRATED EMBODIMENT

Figure 1:
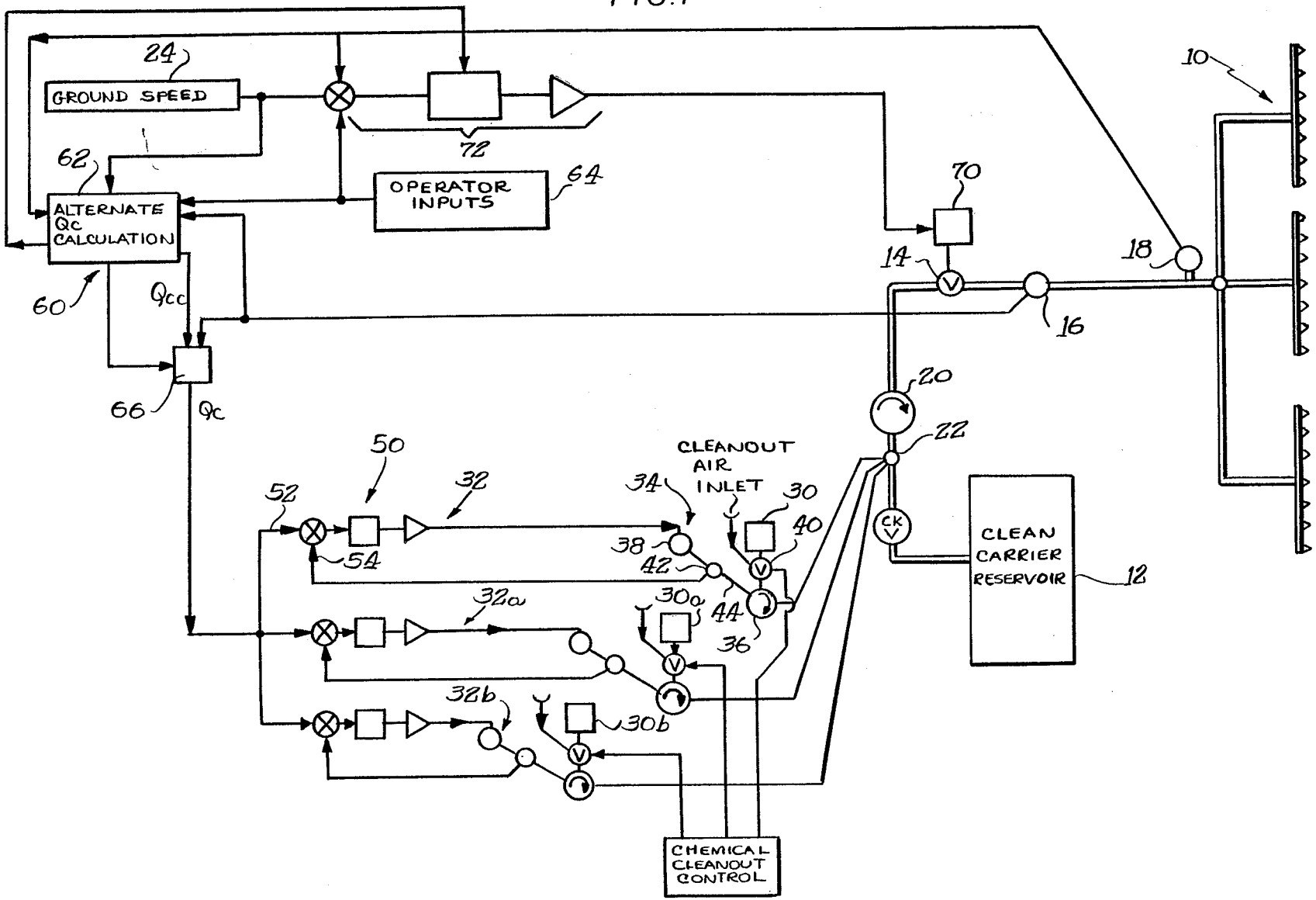
FIG. 1 is a functional schematic diagram of a control injection mixing system in accordance with the invention.

Referring now to the drawing, there is illustrated therein injection mixing apparatus for use with a mobile spraying apparatus in accordance with a preferred embodiment of the invention. The drawing is somewhat diagrammatic in form.

The injection system of the invention is particularly suited for a spraying system which is carried on a mobile vehicle (not shown) and includes one or more spray bars or spray booms 10 and a carrier reservoir 12 for holding a supply of liquid carrier medium, such as water. A flow control valve 14 is interposed between the carrier reservoir 12 and spray bar or spray booms 10. As will be further explained later, a flow meter 16 may also be interposed in the line to the spray booms 10 and preferably following the flow rate control valve 14 for determining the flow rate of fluid to the spray bars 10. A pressure sensor 18 is also preferably coupled in the line to the spray bar 10 to determine the pressure drop across the spray bar 10.

A main pump 20 is located between the carrier reservoir 12 and the flow control valve 14, and a chemical injection point 22, preferably injecting chemical at low pressure, is provided between the reservoir 12 and main pump 20. The main pump 20 may be powered by a tractor or other vehicle power take-off, or other suitable means as desired.

Preferably, the vehicle is also provided with a suitable ground speed sensor 24, which develops an electrical ground speed signal, corresponding to the ground speed of the vehicle which carries or otherwise draws the spraying system across the area to be treated.

A supply of active chemical agent to be mixed with the carrier at a desired concentration for delivery at the spray bar 10 is carried by one or more preferably collapsible chemical reservoirs 30, **30*a*, 30*b*. Control of the rate of injection of chemical from the chemical supply reservoir or reservoirs to the chemical injection point 22 is controlled by one or more corresponding injection control loops 32, 32*a* and 32*b*. It will be understood that three such chemical reservoirs and associated control loops are shown for purposes of illustration only and that fewer or more such reservoirs and control loops might be utilized without departing from the invention. However, the operation of each of the control loops is substantially identical, whereby only the control loop 32** will be described in detail.

The control loop 32 includes injection pump means 34 which, in the illustrated embodiment, comprises a positive displacement pump 36, and a pump drive motor 38. The pump 36 is interposed between the chemical reservoir 30 and the chemical injection point 22. An additional clean out valve 40 may also be interposed between the reservoir 30 and positive displacement pump 36 for clean-out thereof, if desired A pump rotational speed sensor or tachometer 42 is also located at a suitable point to sense the rate of rotation or the injection rate of the pump. In the illustrated embodiment this is done by placing tachometer 42 in a suitable position to monitor the rotational speed of a drive shaft 44 of the pump motor 38 which drives the positive displacement pump 36. This tachometer means produces a rotational speed signal which thereby corresponds to the rotational rate of the pump means 34, and in particular the rate of rotation of the drive shaft 44 which actually drives the pump 36.

A pump control circuit designated generally by reference numeral 50 controls the rate of rotation of the pump means 34 and in particular the rotational rate of the pump motor 38. This control circuit 50 develops a speed control signal in response to the first input signal indicated generally at input 52 and a second input signal comprising a feedback signal from the tachometer 42 as indicated generally at input 54. The first input signal 52 is developed by a system controller designated generally by reference numeral 60 which develops a flow rate signal corresponding to the flow rate of material to the spray bar or spray booms 10 and applies this flow rate signal (Qc) to the pump control circuit 50 as the first input signal at 52.

In the illustrated embodiment, the controller 60 includes a calculating circuit or circuit means 62 which is coupled to receive the pressure signal from the pressure sensor 18 and the ground speed signal from the ground speed sensor or tachometer 24. Further operator inputs are preferably provided as indicated generally at reference numeral 64 for inputting a signal corresponding to the desired application rate of the chemical agent. The operator inputs may further include suitable means for inputting other signals representative of system parameters, such as the spray nozzle parameters and other material parameters, if desired.

The calculating circuit means 60 is responsive to the pressure signal, the ground speed signal and the desired application rate signal for calculating therefrom a "desired" rate of fluid flow to the spray bar necessary for achieving the desired application rate. The calculating circuit delivers this desired or calculated flow rate signal Qcc to an intermediate gate 66 which, under the control of controller 60, may select to feed either this calculated signal Qcc or the actual flow rate signal from flow meter 16, as the flow rate signal Qc to the chemical control circuit 50.

In accordance with a preferred embodiment of the invention, the calculating circuit means 62 is also responsive to the actual flow rate signal varying from the desired flow rate signal by more than some predetermined proportion for developing a warning signal for warning the operator of a possible malfunction in the system.

In accordance with a further aspect of the invention, there is further included in the control system a flow valve control loop for control of a valve actuator 70 for actuating the carrier flow control valve 14, to achieve a desired rate of flow to the spray bar 10. This flow valve control loop includes a controller circuit means 72 which is coupled for delivering the desired flow rate signal based upon the pressure sensor, ground speed sensor and operator inputs to the flow valve actuator in a form suitable for actuating the same to the position for achieving this desired flow rate. This desired flow rate signal may be the same as developed by the calculating circuit or may be independently developed at the control loop 72 for presentation in suitable form to the flow control valve actuator 70.

In accordance with the preferred form of the invention illustrated herein, the controller circuit 60 includes decision means coupled to the flow valve control loop and the injection control loop for controlling one, the other, or both, as necessary in order to maintain a selectable rate of application of material at a selectable concentration at all times. As discussed above, we have recognized that the concentration of material at the flow control valve 14 at any point in time may be regarded as fixed or constant depending upon an already established rate of injection of chemical into the carrier prior to the main pump 20. Because the rate of injection is based on flow rate, this concentration is in theory maintained at the valve 40.

Accordingly, within the acceptable range of operation of the spray nozzles of the boom 10, the rate of application of material and hence its delivered concentration, as delivered to an area to be treated may be controlled by controlling only the flow rate of material of the fixed, desired concentration to the spray booms Beyond the acceptable range of pressure and flow variation for a given set of spray nozzles. The concentration may also be varied by varying the rate of injection into the carrier at injection point 22. However, since this injection is also controlled or controllable in accordance with the flow rate, it will be seen that by cooperative control of both the flow control valve and the injection pumps, it is possible to accommodate changed requirements without any appreciable lag time, and to accommodate changes in application requirements smoothly by coordinating these two control loops.

To this end, the system controller 60 further include means responsive to the pressure signal from pressure sensor 18 reaching some predetermined limit (which may be an upper limit or a lower limit) for causing the calculating circuit to calculate a new flow rate control signal based upon a new pressure (well within acceptable range) across the spray bar. The controller then adjusts the flow rate valve and the injection pump cooperatively to maintain a desired concentration and application density in a gradual phase-in, phase-out fashion so as to return from the pressure limit to the new pressure, while at all times maintaining a relatively smooth and constant desired application rate at the desired chemical concentration. As mentioned above, a ratio of pressure of only about 4:1 may be accommodated by a typical nozzle. Below this given range of pressures, the nozzle will no longer form a true spray, but will tend to drip or dribble, while above this range of acceptable pressures the nozzle will cavitate and produce a highly nonuniform spray pattern The appropriate pressure/flow limitations for any given nozzle type may be readily programmed into the controller 60 to take appropriate action as the limitations are approached, based upon either the pressure sensor 18 or the optional flow meter 16. It is known that pressure is related to flow generally as a square function, such that the aforementioned typical acceptable pressure range of about 4:1 for a typical nozzle translates to about a 2:1 range of flow rates.

Thus, while an increased application rate and/or concentration rate is being accommodated by an opening of the flow control valve to achieve a higher flow rate, at the same time the calculating circuit 62 may begin calculating a new flow rate corresponding to a flow of pressure closer to the optimum operating point of the particular nozzles associated with the spray booms 10. This flow rate can be gradually phased in as the flow rate signals to the injection control loop or loops so as to gradually vary the injection rate while at the same time gradually varying the flow valve in the appropriate direction so as to gradually control the new desired concentration rate while maintaining a more desirable pressure across the nozzles. Advantageously, the above described operation avoids the problems of the prior art associated with lag time in the system in achieving a new and/or modified concentration as between the injection point and the application point at the nozzles.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof Accordingly, the aim in the appended claims is to cover all such changes and modifications as fall within the true spirit and scope of the invention.

The invention is claimed as follows:

1. An injection mixing apparatus for use with a spraying system carried on a mobile vehicle of the type including a spray bar, a carrier reservoir for holding a supply of a liquid carrier medium, a main pump interposed between said carrier reservoir and said spray bar, a flow control valve interposed between said main pump and said spray bar, a ground speed sensor for developing a ground speed signal corresponding to the speed of said vehicle, a pressure sensor for sensing the pressure across the spray bar and developing a corresponding pressure signal and a supply of chemical agent to be mixed with said carrier at a desired concentration for delivery at said spray bar, said apparatus comprising: at least one injection control loop comprising injection pump means coupled intermediate said supply and said main pump for injecting said chemical agent into said carrier ahead of said main pump, and an injection controller for controlling said injection pump means; said injection controller comprising tachometer means for sensing the rotational speed of said injection pump means and developing a corresponding rotational speed signal and a pump control circuit for developing a speed control signal for controlling said rotational speed in response to a first input signal and a feedback signal comprising said rotational speed signal; and a system controller for developing said first input signal including means for developing a flow rate signal corresponding to the flow rate of material to the spray bar, and for applying said flow rate signal to said pump control circuit as said first input signal.

2. Apparatus according to claim 1 wherein said system controller includes calculating circuit means coupled to receive said pressure signal and said ground speed signal, operator control means for inputting a signal corresponding to a desired application rate of said chemical agent, said calculating circuit means being responsive to said pressure signal, said ground speed signal and said desired application rate signal for calculating therefrom a desired rate of fluid flow to the spray bar for achieving said desired application rate and means for delivering said desired flow rate signal to the pump control circuit as the flow rate signal.

3. Apparatus according to claim 2 and further including a flow meter interposed between said flow control valve and said spray bar for developing an actual flow signal corresponding to the actual fluid flow rate thereat and warning means in said calculating circuit responsive to said actual flow signal varying from said desired flow rate signal by more than a predetermined proportion for developing a warning signal for warning the operator of possible system malfunction.

4. Apparatus according to claim 2 and further including operator control means for inputting signals corresponding to a desired rate of application, and spraying parameters including spray nozzle characteristics for use by said calculating means in developing said desired flow rate signal.

5. Apparatus according to claim 2 and further including a flow valve control loop comprising a valve actuator for adjusting the flow control valve to correspondingly adjust the flow of fluid to the spray bar, said controller circuit means being coupled for delivering said desired flow rate signal to the flow control valve actuator, said actuator being responsive to said desired flow rate signal for adjusting the flow control valve to achieve said desired flow rate.

6. Apparatus according to claim 5 wherein said system controller circuit includes decision means coupled to said flow valve control loop and said injection control loop for controlling one, the other, or both, is necessary in order to maintain a selectable rate of application of material at a selectable concentration.

7. Apparatus according to claim 6 wherein said system controller includes means responsive to said pressure signal reaching a predetermined limit for causing said calculating circuit to calculate a new flow rate control si on a predetermined different pressure across the spray bar and for adjusting said flow rate valve injection pump cooperatively to maintain the des application concentration and density in a gradual phase-in/phase-out fashion to return from said pressure limit to said desired pressure while maintaining relatively smooth and constant desired application rate at said desired chemical concentration.

8. Apparatus according to claim 1 and further including a flow meter interposed between said flow control valve and said spray bar for developing an actual flow signal corresponding to the actual fluid flow rate thereat and means for delivering said actual flow signal to said pump control circuit as said first input signal.

9. A spraying system carried on a mobile vehicle, and comprising: a spray bar, a carrier reservoir for holding a supply of a liquid carrier medium, a main pump interposed between said carrier reservoir and said spray bar, a flow control valve interposed between said main pump and said spray bar, a ground speed sensor for developing a ground speed signal corresponding to the ground speed of said vehicle, a pressure sensor for sensing the pressure across the spray bar and developing a corresponding pressure signal and a supply of chemical agent to be mixed with said carrier at a desired concentration for delivery at said spray bar; and an injection mixing apparatus comprising at least one injection control loop including injection pump means coupled intermediate said supply and said main pump for injecting said chemical agent into said carrier ahead of said main pump, drive motor means for driving said pump means and a drive motor controller for controlling said drive means; said drive motor controller comprising tachometer means for sensing the rotational speed of said drive motor means and developing a corresponding drive motor speed signal and a drive motor control circuit for developing a speed control signal for controlling said motor speed in response to a first input signal and a feedback signal comprising said motor speed signal; and a system controller for developing said first input signal including means for developing a flow rate signal corresponding to the flow rate to the spray bar, and for applying said flow rate signal to said motor control signal as said first input signal.

* * * * *

UNITED STATES PATENT AND TRADEMARK OFFICE

CERTIFICATE OF CORRECTION

PATENT NO. : 4,967,957

DATED : November 6, 1990

INVENTOR(S) : Wesley J. Bachman

It is certified that error appears in the above-identified patent and that said Letters Patent is hereby corrected as shown below:

Column 4, line 57, after "desired" insert --.--

Column 7, line 14, after "thereof" insert --.--.

Column 8, line 25, delete "si" and insert --signal based--.

Column 8, line 26, after "valve" insert --and said--.

Column 8, line 27, delete "des" and insert --desired--.

Column 8, line 30, after "maintaining" insert --a--.

Signed and Sealed this

Ninth Day of June, 1992

*Attest:*

*Attesting Officer*

DOUGLAS B. COMER

*Acting Commissioner of Patents and Trademarks*